US006426132B1

(12) United States Patent
Stewart

(10) Patent No.: US 6,426,132 B1
(45) Date of Patent: Jul. 30, 2002

(54) FLEXIBLE, LAMINATED SHOE HORN

(76) Inventor: Carl Stewart, 113 Plano St., Shreveport, LA (US) 71103-2054

( * ) Notice: Subject to any disclaimer, the term of this patent is extended or adjusted under 35 U.S.C. 154(b) by 0 days.

(21) Appl. No.: 09/548,842

(22) Filed: Apr. 13, 2000

(51) Int. Cl.[7] ..... A47G 25/82; B32B 3/24

(52) U.S. Cl. ..... 428/137; 428/131; 428/141; 428/81; 428/319.3; 428/483; 428/522; 442/38; 223/118; 223/119; D2/642

(58) Field of Search ..... 428/137, 81, 131, 428/319.3, 483, 522, 141; 223/118, 119; 442/38; D2/642

(56) References Cited

U.S. PATENT DOCUMENTS

| | | | | |
|---|---|---|---|---|
| 1,573,729 A | | 2/1926 | Martin | 223/118 |
| 1,913,709 A | | 6/1933 | Gutman | 223/118 |
| 2,366,097 A | | 12/1944 | Gesell | 233/118 |
| 3,165,246 A | | 1/1965 | Stearns | 223/118 |
| 3,396,883 A | | 8/1968 | Batista | 223/118 |
| 3,436,000 A | | 4/1969 | Batista | 223/118 |
| D258,249 S | | 2/1981 | Harris | D2/378.2 |
| 4,893,418 A | * | 1/1990 | Ogden | 36/44 |
| D355,522 S | | 2/1995 | Simpson | D2/642 |
| D360,743 S | | 8/1995 | Simpson | D2/642 |
| 5,741,569 A | | 4/1998 | Votino | 428/131 |

* cited by examiner

*Primary Examiner*—William P. Watkins, III
(74) *Attorney, Agent, or Firm*—John M. Harrison

(57) ABSTRACT

A laminated shoehorn which is characterized by an elongated, flexible shoehorn body having a substantially rough backing layer and a substantially smooth foot contact layer laminated to the backing layer. The shoehorn body is typically shaped with an elongated center portion having a circular grip at one end and a widened, arcuate heel guide at the other end of the center portion for supporting the user's heel. A hanging opening may be provided in the grip to facilitate hanging the shoehorn from a nail, hook or the like. The smooth foot contact layer facilitates slipping of the user's foot into a shoe, and the rough backing layer of the shoehorn body contacts the shoe and prevents the shoehorn from sliding into the shoe beneath the user's foot. In a preferred embodiment the backing layer is thin cheesecloth, polyester or foam rubber and the foot contact layer is vinyl. The shoehorn is durable and capable of substantially conforming to the configuration of the user's heel and prevents stretching or damage of the shoe.

20 Claims, 1 Drawing Sheet

FLEXIBLE, LAMINATED SHOE HORN

BACKGROUND OF THE INVENTION

1. Field of the Invention

This invention relates to shoehorns and more particularly, to a laminated shoehorn which prevents stretching, distortion or damage of a shoe and comfortably conforms to the configuration of the shoe wearer's heel as the wearer uses the shoehorn to insert his or her foot in the shoe. In a preferred embodiment the laminated shoehorn is characterized by an elongated, flexible, durable shoehorn body of selected size and thickness having laminated backing and foot contact layers. The shoehorn body is typically shaped with an elongated center portion having a circular grip at one end and a widened, elongated, arcuate heel guide at the other end of the center portion for supporting the shoe wearer's heel. The substantially smooth foot contact layer of the shoehorn body contacts the wearer's heel and facilitates comfortable and easy slipping of the wearer's foot into the shoe, while the substantially rough or course backing layer contacts the shoe and prevents the shoehorn body from sliding into the shoe beneath the wearer's foot. The backing layer of the shoehorn body is typically a thin sheet of cheesecloth, polyester, foam rubber or other durable material having a substantially course texture, and the foot contact layer is typically a thin sheet of nylon or other material having a substantially smooth texture. A hanging opening may be provided in the grip of the shoehorn body to facilitate hanging the shoehorn from a nail, hook or the like.

Shoehorns have been widely used for many years to assist people in inserting their feet in shoes, particularly in tight shoes or new shoes which have not been "broken in". Conventional shoehorns are typically constructed of rigid plastic or metal and have a curved cross-sectional shape. The narrow, upper end of the shoehorn is typically curved to define a handle in the shoehorn. The shoehorn is positioned in a sloped configuration in the shoe socket at the back end thereof and, while holding the handle of the shoehorn with one of his or her hands, the wearer slides his or her heel down the shoehorn until his or her foot is positioned in the shoe. Because the shoehorn is rigid, it is incapable of conforming to the configuration of the shoe wearer's heel and is thus frequently uncomfortable or painful to use. Moreover, the pressure exerted on the back of the shoe after repeated use of the rigid shoehorn may distort, stretch or damage the shoe.

2. Description of the Prior Art

Shoehorns of various designs are known in the art. U.S. Pat. No. 1,573,729, dated Feb. 16, 1926, to Harry Martin, describes a "Shoehorn", characterized by a rigid member foldably attached to a flexible member, which rigid member is adapted for guiding a user's foot into the shoe socket of a shoe as the user grasps the flexible member. A strap is provided on the flexible member of the shoehorn for hanging the shoehorn on clothing, and a hook is provided on the strap for receiving the rigid member and securing the shoehorn in a folded configuration, as desired. U.S. Pat. No. 1,913,709, dated Jun. 13, 1933, to Eugene J. Gutmann, discloses a "Flexible Shoe Horn" adapted to be used with sore or tender heels. The flexible shoe horn is characterized by an elongated strip constructed of an inner, resilient cushion layer sandwiched between a pair of flexible, typically fibrous outer layers. The shoehorn has a narrow handle end and a wider heel support end for supporting the heel of the user's foot as the user slides his or foot into a shoe while grasping the handle end. An aperture is provided in the handle end for hanging the shoehorn from a hook or nail, as desired. A "Shoe Horn" is detailed in U.S. Pat. No. 2,366,097, dated Dec. 26, 1944, to Frank A. Gesell. The shoe horn is constructed of an elongated, flexible, pliable plastic sheet and has a wide end adapted for use by men and a narrower end for use by women. The shoe horn is creased longitudinally, thus enabling the shoe horn to substantially conform to the arcuate shape of a user's heel. Lateral projections which extend outwardly from the middle portion of the shoe horn limit insertion of the shoe horn into a shoe to prevent the shoe horn from sliding under the user's heel as the user's foot is slided into the shoe. U.S. Pat. No. 3,165,246, dated Jan. 12, 1965, to Orlon F. Stearns, describes "Shoe Horns" each characterized by an elongated support having a curved, flexible guide mounted on the support for guiding a shoe wearer's heel into a shoe as the guide is positioned in the shoe using the support. The guide is constructed of thin metal and can be bended before use to substantially conform to the shape of the user's heel. A "Flexible Shoehorn" is described in U.S. Pat. No. 3,396,883, dated Aug. 13, 1968, to Jose H. Batista. The shoehorn is constructed of a flat, symmetrical sheet of tough, flexible, pliable material having a narrow rounded end and a broad rounded end, connected by an intermediate portion. The narrow end of the shoehorn is curved from the plane of the intermediate portion and broad rounded end, to form a handle in the shoehorn. Multiple, longitudinally-extending score lines in the shoehorn impart a curved cross-sectional configuration thereto. U.S. Pat. No. 3,436,000, dated Apr. 1, 1969, also to Jose H. Batista, details a "Shoehorn", characterized by a rigid plastic handle, continuous with a thin, flexible, plastic tongue which is used to guide the heel of a user into the heel socket of a shoe as the user grasps the handle. A "Flexible Shoe Horn" is shown and described in U.S. Des. 258,249, dated Feb. 17, 1981, to John M. Harris. U.S. Des. 355,522, dated Feb. 21, 1995, to Harold G. Simpson, shows and describes a "Flexible Plastic Shoehorn". Another "Flexible Plastic Shoehorn" is shown and described in U.S. Des. 360,743, dated Aug. 1, 1995, also to Harold G. Simpson. U.S. Pat. No. 5,741,569, dated Apr. 21, 1998, to Anthony Votino, describes a "Shoe and Sock Donning Device for Physically Handicapped" for enabling a handicapped user to insert his or her foot in a sock and shoe simultaneously. The device is characterized by an arcuate support constructed of a generally rectangular sheet of thin, semirigid, flexible material which is folded into a C-shaped cross-sectional configuration. When inserted in the socket of a shoe, the lower portion of the folded support applies outward recoil pressure against the mouth of the shoe socket, to hold the shoe socket in an open position. The upper portion of the support serves as a frame for receiving a sock, with the toe of the sock positioned inside the support. The sock and shoe are donned by inserting the foot into the sock and sliding the foot downwardly and forwardly into the shoe, through the support.

An object of this invention is to provide a flexible laminated shoehorn for use in comfortably inserting a user's feet in tight shoes.

Another object of this invention is to provide a substantially flat, flexible laminated shoehorn of selected size and thickness which substantially conforms to the heel size and configuration of a user as the user inserts his or her foot into a shoe using the shoehorn.

Still another object of this invention is to provide a flexible laminated shoehorn of simple construction which is capable of substantially conforming to feet of various sizes and configurations in the comfortable insertion of users' feet in shoes.

Yet another object of this invention is to provide a flexible laminated shoehorn which is substantially flat, durable, comfortable to use and easy to store and does not distort, stretch or damage shoes.

Still another object of this invention is to provide a durable, flexible laminated shoehorn which includes a substantially rough or course surface for engaging the interior of a shoe and a substantially smooth surface for engaging a user's heel as the user slides his or her heel on the shoehorn and inserts his or her foot in the shoe, which course surface of the shoehorn prevents the shoehorn from sliding into the shoe beneath the user's foot.

Another object of this invention is to provide a flexible laminated shoehorn characterized by an elongated, flexible shoehorn body having a typically cheesecloth backing layer and a typically vinyl foot contact layer laminated to the backing layer, which foot contact layer includes a substantially smooth foot contact surface for contacting and sliding a user's heel into the shoe socket of a shoe and positioning the user's foot in the shoe, and which backing layer includes a substantially rough or course shoe contact surface which engages the shoe and prevents the shoehorn from slipping into the shoe beneath the user's foot.

A still further object of this invention is to provide a flexible laminated shoehorn characterized by an elongated shoehorn body constructed of a substantially rough backing layer and a substantially smooth foot contact layer laminated to the backing layer, which shoehorn body is typically shaped with an elongated center portion having a circular grip at one end and a widened, elongated, arcuate heel guide shaped at the other end of the center portion for supporting and substantially conforming to the shoe wearer's heel as the wearer slides his or her heel on the heel guide of the shoehorn body into the shoe socket of a shoe while comfortably inserting his or her foot in the shoe.

SUMMARY OF THE INVENTION

These and other objects of the invention are provided in a laminated flexible shoehorn characterized by an elongated, flexible, shoehorn body which is constructed of laminated backing and foot contact layers of selected durable material. In a preferred embodiment the shoehorn body of selected size and thickness is shaped with an elongated center portion having a typically circular grip at one end and an elongated, widened, arcuate heel guide at the other end of the center portion for supporting the shoe wearer's heel. The foot contact layer has a substantially smooth texture which contacts the shoe wearer's heel and facilitates slipping of the wearer's foot into the shoe, and the backing layer has a substantially rough or course texture which contacts the shoe and prevents the shoehorn from sliding into the shoe beneath the wearer's foot. The backing layer of the shoehorn is typically thin cheesecloth, polyester, foam rubber or other material having a substantially rough or course texture, and the foot contact layer is typically vinyl or other material having a substantially smooth texture. A hanging opening may be provided in the grip of the shoehorn body to facilitate hanging the shoehorn from a nail, hook or the like.

BRIEF DESCRIPTION OF THE DRAWINGS

The invention will be better understood by reference to the accompanying drawing, wherein.

DESCRIPTION OF THE PREFERRED EMBODIMENTS

Figure 2:
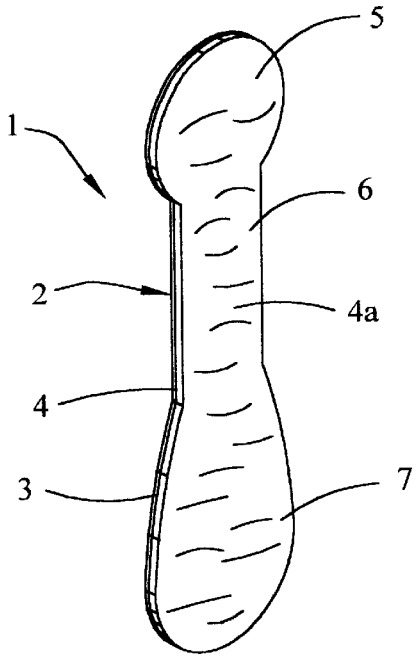
FIG. 2 is a perspective view of the flexible laminated shoehorn illustrated in FIG. 1.
Figure 3:
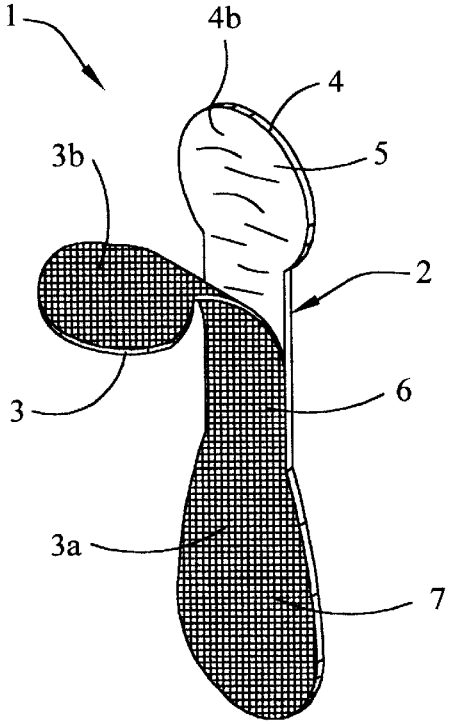
FIG. 3 is a perspective view of the flexible laminated shoehorn, with the backing layer shown partially peeled from the foot contact layer of the shoehorn.
Figure 4:
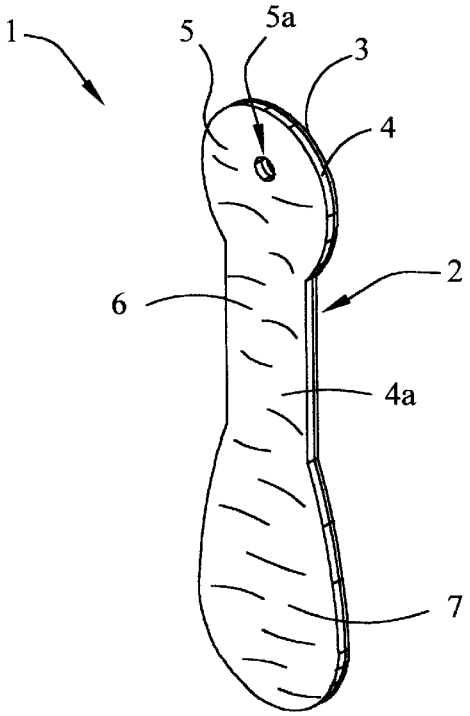
FIG. 4 is a perspective view of another embodiment of the flexible laminated shoehorn.

Referring initially to FIGS. 2–4 of the drawing, in a preferred embodiment the flexible laminated shoehorn, hereinafter referred to as the shoehorn, of this invention is generally illustrated by reference numeral 1. The shoehorn 1 is characterized by an elongated, flexible, laminated shoehorn body 2 typically having an elongated center portion 6, a rounded grip 5 of selected diameter and configuration at one end of the center portion 6 and an elongated, arcuate heel guide 7 at the opposite end of the center portion 6. The laminated shoehorn body 2 includes a backing layer 3 which is typically constructed from a thin sheet of cheesecloth and has a substantially rough or course shoe contact surface 3*a*, as illustrated in FIG. 3. The backing layer 3 can alternatively be constructed from a thin sheet of polyester, foam rubber or any other durable, flexible material which has a substantially rough or course texture for the shoe contact surface 3*a*. A substantially congruent, typically nylon foot contact layer 4 of the shoehorn body 2 includes a laminate surface 4*b* which adheres to the laminate surface 3*b* of the backing layer 3 by means of glue or any other suitable adhesive, or alternatively the foot contact layer 4 can be stitched or otherwise attached to the backing layer 3 according to the knowledge of those skilled in the art. The foot contact layer 4 further includes a substantially smooth foot contact surface 4*a*opposite the laminate surface 4*b*, as illustrated in FIG. 2, the purpose of which foot contact surface 4*a* will be hereinafter described. Accordingly, the grip 5, center portion 6 and heel guide 7 of the shoehorn body 2 each typically has the rough shoe contact surface 3*a* of the backing layer 3 and the opposite, smooth foot contact surface 4*a* of the foot contact layer 4. While the thicknesses of the backing layer 3 and foot contact layer 4 are chosen such that the shoehorn body 2 typically has a thickness of about 1/16", 3/64" or 1/32", it will be understood that the shoehorn body 2 can be any desired thickness which is consistent with the functional requirements of the shoehorn 1. Preferably, the thickness of the shoehorn body 2 does not exceed about 1/16", since the shoehorn body 2 must be sufficiently flexible to substantially conform to the configuration of a user's heel during use, as hereinafter described. As illustrated in FIG. 4, a hanging opening 5*a* may extend through the grip 5 of the shoehorn body 2, to facilitate hanging the shoehorn 1 from a nail or hook (not illustrated). Accordingly, the embodiment of the shoehorn 1 illustrated in FIG. 4 typically has a grip 5 of the same or slightly smaller diameter or size than that of the grip 5 of the shoehorn 1 illustrated in FIG. 2.

Figure 1:
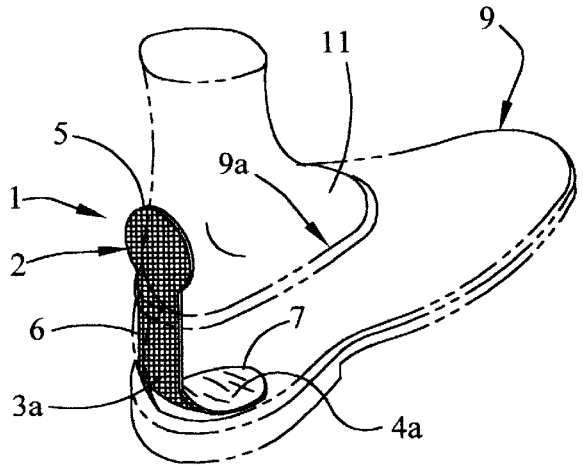
FIG. 1 is a perspective view of a shoe, illustrated in phantom, more particularly illustrating insertion of a user's foot, also illustrated in phantom, into the shoe using the flexible laminated shoehorn of this invention.

Referring next to FIGS. 1 and 4 of the drawing, in application of the shoehorn 1 the heel guide 7 of the shoehorn body 2 is initially inserted in a shoe 9 (illustrated in phantom in FIG. 1), through the shoe socket 9*a* of the shoe 9. The shoehorn body 2 is bended at the junction between the center portion 6 and heel guide 7, and the shoe contact surface 3*a* portion of the heel guide 7 of the shoehorn body 2 is caused to rest on the bottom of the shoe 9 while the shoe contact surface 3*a* portion of the center portion 6 rests against the rear of the shoe 9, inside the shoe socket 9*a*.

Accordingly, the foot contact surface 4*a* portion of the heel guide 7 faces upwardly in the shoe 9, and the grip 5 of the shoehorn body 2 extends upwardly from the shoe socket 9*a*, as illustrated. The foot 11 (illustrated in phantom) of a user is then inserted forwardly into the shoe 9 through the shoe socket 9*a*, and the heel (not illustrated) of the user's foot 11 is initially lowered into contact with the smooth foot contact surface 4*a* of the center portion 6 of the shoehorn body 2. As the user continues to lower the heel of his or her foot 11 against the smooth foot contact surface 4*a*, his or her heel slides on the foot contact surface 4*a* from the center portion 6 to the horizontal heel guide 7 of the shoehorn body 2, and his or her foot 11 simultaneously slides forwardly in the shoe 9. Due to the flexibility of the laminated shoehorn body 2, the center portion 6 is pushed against the rear of the shoe 9 in the shoe socket 9*a* as the center portion 6 and heel guide 7 substantially conform to the configuration of the user's descending foot 11, and this imparts a comfortable feel to the user's foot 11. Because of the rough or course texture of the shoe contact surface 3*a*, the shoehorn body 2 is prevented from slipping into the shoe 9 as the user slides his or her foot 11 on the shoehorn body 2. Finally, the shoehorn body 2 is removed from the shoe 9 by pulling upwardly on the grip 5 of the shoehorn body 2. The embodiment of the shoehorn body 2 illustrated in FIG. 4 can be hanged from a nail or hook (not illustrated) by inserting the hanging opening 5*a* in the grip 5, on a nail or hook (not illustrated) extending from a wall or door, for example.

It will be appreciated by those skilled in the art that the shoehorn of this invention is durable, simple in construction, easy to store and capable of substantially conforming to the size and contour of any foot in order to facilitate comfortably and easily positioning a user's foot in a tight shoe. Referring again to FIG. 1 of the drawing, an important feature of the shoehorn 1 is the rough or course shoe contact surface 3*a* on one side of the shoehorn body 2 for contacting the shoe 9 and preventing the shoehorn body 2 from slipping into the shoe 9, and the smooth foot contact surface 4*a* on the opposite side of the flexible shoehorn body 2 which facilitates ease and comfort in sliding the user's heel and foot 11 into the shoe 9. Another important feature is the flexibility and durability of the shoehorn 1 due to the mutual reinforcement of the backing layer 3 and foot contact layer 4 of the laminated shoehorn body 2. While the backing layer 3 of the shoehorn body 2 has been described above as constructed from a thin sheet of cheesecloth, polyester or foam rubber, it is understood that any durable material having a substantially rough or course texture which would prevent the shoehorn body 2 from slipping into the shoe 9 during use would be suitable for the backing layer 3. Moreover, the foot contact layer 4 of the shoehorn body 2 can be constructed from any durable sheet material which has a substantially smooth surface for the foot contact surface 4*a*, including but not limited to vinyl. It is further understood that the shoehorn body 2 can be constructed of more than two layers of the backing layer 3 and/or the foot contact layer 4, as long as the backing layer 3 has the course texture for contacting the shoe 9 and the foot contact layer 4 has the smooth texture for sliding the user's foot 11 into the shoe 9, although the entire thickness of the shoehorn body 2 preferably does not exceed about 1/16", as heretofore described. It will be further appreciated by those skilled in the art that the shoehorn body 2 can be constructed in various sizes and colors for use by persons of all sizes and ages.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A method for aiding in positioning a user's foot in a shoe, comprising providing a flexible shoehorn body having a front end and a rear end and a substantially course shoe contact surface for engaging the shoe and a substantially smooth foot contact surface opposite said shoe contact surface for engaging the foot of the user; inserting said front end of said shoehorn body in the shoe and extending said rear end of said shoehorn body from the shoe, with said shoe contact surface of said shoehorn body contacting the shoe; inserting the user's foot in the shoe with the user's foot engaging said shoe contact surface of said shoehorn body, and pressing the user's foot against said shoe contact surface of said shoehorn body, whereby said shoe contact surface prevents said shoehorn body from slipping into the shoe, said foot contact surface facilitates sliding of the user's foot into the shoe and said shoehorn body substantially conforms to the shape of the user's foot, as the user inserts his or her foot in the shoe; and removing said shoehorn body from the shoe.

2. The method of claim 1 wherein said shoehorn body comprises a backing layer and a foot contact layer laminated to said backing layer, and wherein said shoe contact surface is provided on said backing layer and said foot contact surface is provided on said foot contact layer.

3. The method of claim 1 comprising providing a grip in said rear end of said shoehorn body.

4. The method of claim 3 wherein said shoehorn body comprises a backing layer and a foot contact layer laminated to said backing layer, and wherein said shoe contact surface is provided on said backing layer and said foot contact surface is provided on said foot contact layer.

5. The method of claim 3 comprising providing a heel guide in said front end of said shoehorn body.

6. The method of claim 5 wherein said shoehorn body comprises a backing layer and a foot contact layer laminated to said backing layer, and wherein said shoe contact surface is provided on said backing layer and said foot contact surface is provided on said foot contact layer.

7. The method of claim 5 comprising providing a center portion between said grip and said heel guide of said shoehorn body.

8. The method of claim 7 wherein said shoehorn body comprises a backing layer and a foot contact layer laminated to said backing layer, and wherein said shoe contact surface is provided on said backing layer and said foot contact surface is provided on said foot contact layer.

9. A method for aiding in positioning a shoe wearer's foot in a tight shoe, comprising providing a laminated shoehorn body including a front end, a rear end, a flexible backing layer having a substantially course shoe contact surface and a flexible, vinyl foot contact layer laminated to said backing layer, said foot contact layer having a substantially smooth foot contact surface for engaging the foot of the wearer; inserting said front end of said shoehorn body in the shoe and extending said rear end of said shoehorn body from the shoe, with said shoe contact surface of said shoehorn body contacting the shoe; inserting the user's foot in the shoe with the user's foot engaging said shoe contact surface of said shoehorn body; and pressing the user's foot against said shoe contact surface of said shoehorn body, whereby said shoe contact surface prevents said shoehorn body from slipping into the shoe, said foot contact surface facilitates sliding of the wearer's foot into the shoe and said shoehorn body substantially conforms to the shape of the wearer's foot, as the wearer inserts his or her foot in the shoe; and removing said shoehorn body from the shoe.

10. The method of claim 9 wherein said backing layer of said shoehorn body comprises cheesecloth.

11. The method of claim 9 comprising a grip shaped in said rear end of said shoehorn body, a heel guide shaped in said front end of said shoehorn body and a center portion connecting said grip and said heel guide of said shoehorn body.

12. The method of claim 11 wherein said backing layer of said shoehorn body comprises cheesecloth.

13. The method of claim 9 wherein said backing layer of said shoehorn body comprises polyester.

14. The method of claim 13 comprising providing a grip in one end of said shoehorn body, a heel guide in the opposite end of said shoehorn body and a center portion connecting said grip and said heel guide of said shoehorn body.

15. The method of claim 9 wherein said backing layer of said shoehorn body comprises foam rubber.

16. The method of claim 15 comprising providing a grip in one end of said shoehorn body, a heel guide in the opposite end of said shoehorn body and a center portion connecting said grip and said heel guide of said shoehorn body.

17. A shoehorn for aiding in positioning a shoe wearer's foot in a tight shoe, comprising a laminated shoehorn body including a flexible backing layer and a flexible, vinyl foot contact layer laminated to said backing layer; a substantially course shoe contact surface provided on said backing layer for engaging the shoe; a substantially smooth foot contact surface provided on said foot contact layer for engaging the foot of the user, whereby said shoe contact surface prevents said shoehorn body from slipping into the shoe, said foot contact surface facilitates sliding of the wearer's foot into the shoe and said shoehorn body substantially conforms to the shape of the wearer's foot, as the wearer inserts his or her foot in the shoe; and a hanging opening provided in said shoehorn body at one end of said shoehorn body for hanging said shoehorn body.

18. The shoehorn of claim 17 wherein said backing layer of said shoehorn body comprises cheesecloth.

19. The shoehorn of claim 17 comprising a grip shaped in one end of said shoehorn body, a heel guide shaped in the opposite end of said shoehorn body and a center portion connecting said grip and said heel guide of said shoehorn body.

20. The shoehorn of claim 19 wherein said backing layer of said shoehorn body comprises cheesecloth.

* * * * *